United States Patent [19]

Stout

[11] 4,025,021

[45] May 24, 1977

[54] CONCRETE FORM FOR CASTING-IN-PLACE A CONCRETE STRUCTURE

[76] Inventor: Robert K. Stout, Nizza 12, Piso 5°, Mexico D.F. 6, Mexico

[22] Filed: Feb. 17, 1976

[21] Appl. No.: 658,344

[52] U.S. Cl. ..... 249/61; 249/28; 249/189; 249/196

[51] Int. Cl.[2] ..... E04G 11/40

[58] Field of Search ..... 249/28–32, 249/175–177, 184, 189, 196, 212, 61

[56] References Cited

UNITED STATES PATENTS

| | | | |
|---|---|---|---|
| 982,055 | 1/1911 | Hallberg | 249/29 |
| 1,129,144 | 2/1915 | Venable | 249/189 |
| 1,227,769 | 5/1917 | Fitch | 249/29 |
| 1,891,557 | 12/1932 | Roos | 249/31 |
| 3,421,551 | 1/1969 | Currier | 249/177 |
| 3,543,458 | 12/1970 | Guritz | 249/28 |
| 3,734,451 | 5/1973 | Tierney | 249/196 |

FOREIGN PATENTS OR APPLICATIONS

| | | | |
|---|---|---|---|
| 818,228 | 9/1937 | France | 249/28 |
| 1,004,503 | 3/1952 | France | 249/176 |
| 497,400 | 9/1954 | Italy | 249/28 |

*Primary Examiner*—Richard B. Lazarus
*Assistant Examiner*—John McQuade
*Attorney, Agent, or Firm*—Anthony J. Casella

[57] ABSTRACT

A concrete form which is particularly suited for casting-in-place concrete structures, such as a building, comprises a plurality of metallic form members that are interconnected so as to define a planar form surface having a plurality of spaced, parallel elongated depressions extending across the entire length of the form. The resulting concrete structure is generally planar having a relatively thin planar surface which is reinforced by unitary, spaced, parallel beams formed by said depressions. The resulting structure is of comparable strength to a thicker slab of concrete, requires less concrete, and provides spacing in-between the parallel beams for the ducting of utility lines. In a modification, the depressions may also include frangible mandrels which may be readily punched out of the concrete structure to enable the ducting of utility lines transverse to the beams of concrete.

7 Claims, 16 Drawing Figures

CONCRETE FORM FOR CASTING-IN-PLACE A CONCRETE STRUCTURE

DESCRIPTION OF THE INVENTION

Figure 1:
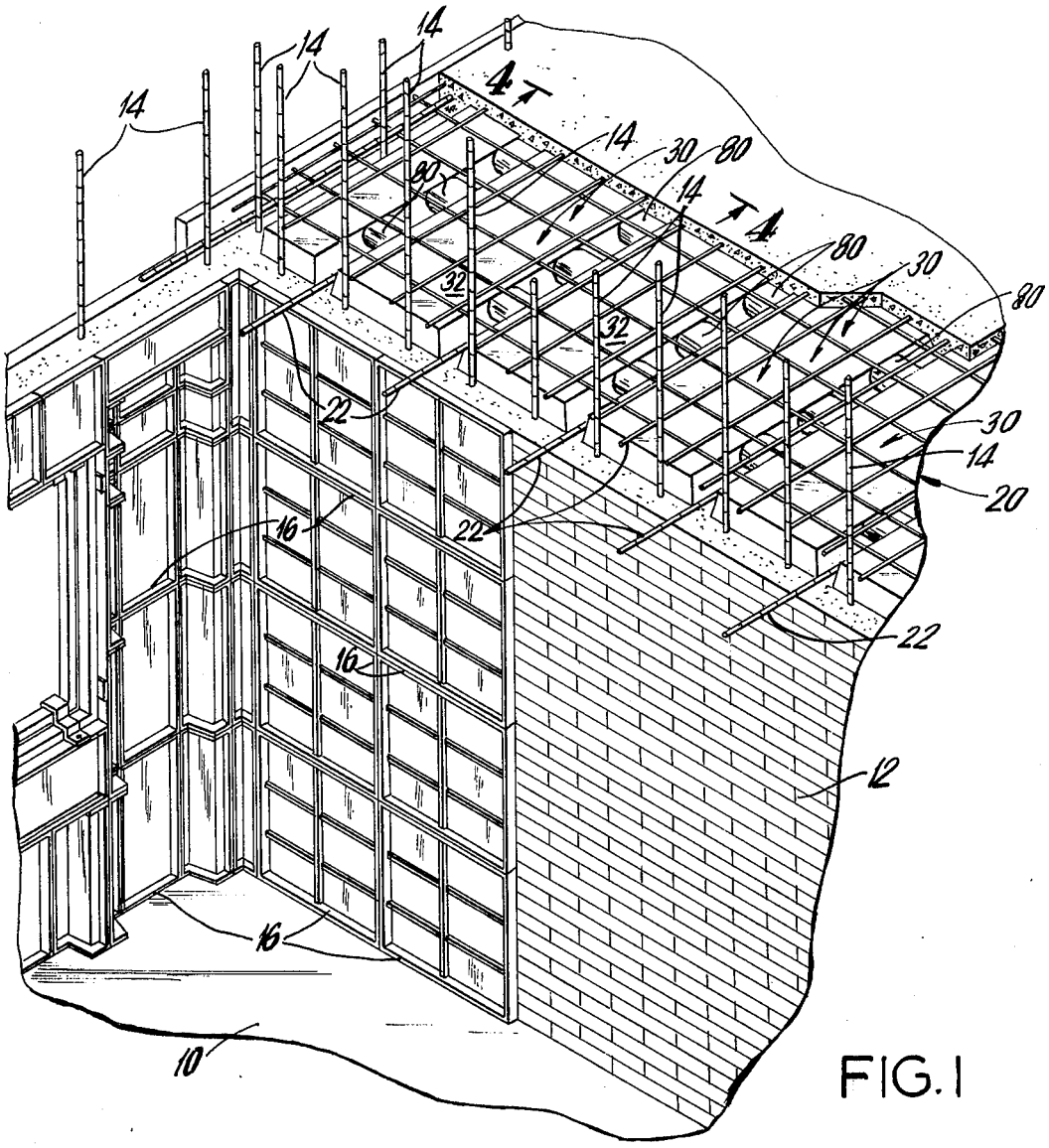

The present invention relates to a concrete form for casting-in-place a concrete structure, and more particularly, a concrete form particularly suited for casting-in-place a concrete building structure having foundation, upstanding walls, ceiling and roof panels of specific configuration, as well as the resulting building structure.

Heretofore, in casting-in-place construction techniques, it has been the general technique of employing large planar concrete forms which are uniformly separated so as to result in a uniformly thick upstanding wall structure, after which for purposes of forming the ceiling or roof of the concrete structure, it has been common practice to provide forms which are supported by very complicated heavy shoring structures, to define the ceiling or roof. Concrete, usually at a depth of a minimum of 4 inches, is then poured into the form, and allowed to cure, after which the shoring means and forms are removed. The resulting upstanding wall structure, as well as the ceiling and roof structure are usually of uniform thickness, thereby resulting in high construction costs including labor and materials. Furthermore, the thickness of the concrete requires additional reinforcing steel, as well as additional curing time for the concrete.

It has also been known in the construction industry, for the purpose of reducing the amount of concrete employed in the construction of the foundation or floors or a building, to provide a T-beam cavity construction. The equipment employed in that technique employs extremely large heavy panels of identical construction, usually on the order of 2 feet by 8 feet. Because of their size and weight, the versatility of employing such large panels is greatly limited, and their application is primarily for purposes of horizontal flat structures, such as the floors or foundation.

Accordingly, it is a primary object of the subject invention to provide a new and improved concrete form for casting-in-place a concrete structure, either a foundation panel, upstanding wall panel, ceiling or roof panel, that greatly reduces the amount of concrete required, the amount of reinforcing steel, the curing time, and yet in no way reduces the structural capability of the resulting building structure.

It is a further object of the subject invention to provide a concrete form that allows for interchangable form pieces that will allow filler pieces of any standard forming system to be adapted to the subject form system.

The subject system provides for the necessary predetermined spacing of the concrete supporting beams in a floor or roof structure, which, of course, is essential to construction structural requirements and is necessary to the economy of the system, as the unitary beams can be left exposed if spaced properly so as to accomplish considerable economy in a floor structure. The subject forms can be of variable size so as to meet any structural span requirements in floors, for example, and also to meet any requirement as far as the size of structural vertical posts in wall members. As indicated above, although there have been other systems that have created beams in horizontal floors, the prior art systems have not been used for walls and cannot build walls necessary for housing because of the lack of flexibility or adaptability of the prior art systems to the many different dimensional requirements created by openings such as windows, doors, etc., or to create a column beam in the upstanding walls.

The subject invention overcomes the shortcoming of the prior art by employing S-shaped forms, two of which are interconnected so as to form a U-shaped depression form that is coupled with variable size planar forms in order to create the upstanding walls and horizontal floor and ceiling structures of a cast-in-place concrete structure. The S-form of the subject invention when employed in combination with standard forms can meet any longitudinal dimensional requirements for the floors and walls of the concrete structure, and in addition, allow for a longitudinal change in dimension between beams or posts to meet any structural requirement. The variable depth sizes of the S-form of the subject invention also allows for a change in depth of floor beams and wall columns to meet any strength and span requirements of floors or walls. The S-shaped form of the subject invention has great inherent strength because of its configuration, and being principally made of a lightweight all-aluminum material allows the forms to be handled in room lengths of 14 feet, 16 feet, or longer. Thus, the forms may be man-handled, and pieces up to three times larger than any other forming system may be employed in the construction of a concrete structure. This capability of man-handling of the forms can cut labor costs of erecting the forms up to 50% when contrasted to prior art systems. Still furthermore, other prior art forming systems which have employed to create T-beam floors require many supporting jacks and structures, whereas because of the inherent strength of the S-shaped form of the subject invention, the subject forms greatly reduce the amount of shoring required for the forms when forming an intermediate floor or ceiling. The S-shaped form of the subject invention is inherently strong and light in weight, and may effectively eliminate two-thirds of the ordinarily required trusses and jacks required in prior art systems, and thus will also minimize the amount of labor required for the erection of the subject forming system.

In summary, unlike prior art systems, the subject invention provides a complete system of forms and accessories necessary to build a complete cast-in-place T-beam structure, for example a building, including floor, walls, interior partitions, and roof. The S-form of the subject invention in combination with the other necessary pieces of the equipment of the subject invention, for the first time, create, a completely T-beam cavity system, which is flexible enough in dimensional capability to adapt to the many and complex irregular requirements of building structures created by irregular room sizes, closets, dimensions around openings, lengths and heights of walls, etc., encountered in complex building structures. The S-form of the subject invention combined with standard form sizes can meet any dimensional requirement with standard pieces of length and width and beam spacing, and even the depth of the resulting concrete beams and columns may be varied, as dictated by the structural requirements of the building structure.

The resulting concrete structure, whether a vertical wall or horizontal floor, is characterized by having a planar concrete structure which is formed unitary with parallel strips of concrete, with the parallel strips of concrete functioning as reinforcing beams or columns. Each of the metallic form members of the subject invention is preferably made of a light weight aluminum material, and includes a form surface that is reinforced by a peripheral flange, with the flanges including apertures to accept the releasable securing means for joining the forms together. The subject forms are configured to include flat planar forms, as well as modified S-shaped forms that are mirror image in cross-section, whereby two such forms may be joined to define the elongated depression between a pair of planar forms. As an example of the concrete structure that may be constructed employing the subject invention, in lieu of a conventional ceiling of uniform thickness of approximately four inches, a concrete structure made according to the subject invention, amy include a planar concrete slab of approximately one and one-half inches in depth and having integrally formed therewith spaced parallel strips or beams of concrete that are on the order of 6 inches in depth for a span of about 14 feet. For ease of removal of the subject concrete forms, the depressions may be tapered, and in an alternate embodiment, removable frangible spacers may be provided in the form depressions prior to pouring of the concrete whereby the embedded frangible spacers may be readily removed for ducting utility lines and the like transverse to the elongated beams.

In summary, the subject concrete form provides a new and improved concrete structure that is achieved with reduced labor requirements, reduced material requirements, and reduced curing time for the construction of the concrete structure, all of which results in a significant cost reductions in the making of the concrete structure.

Figure 2:
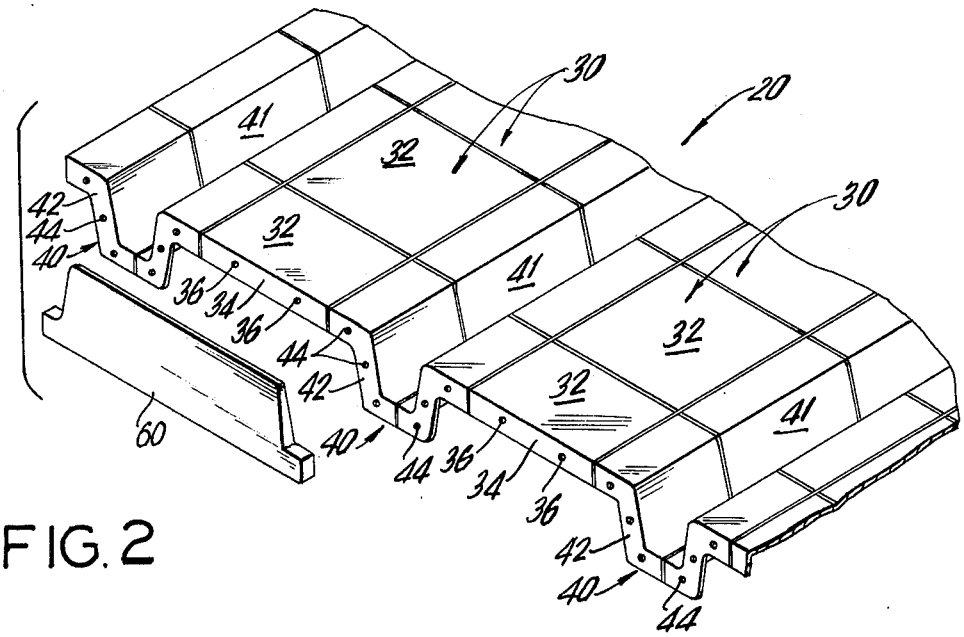
Figure 3:
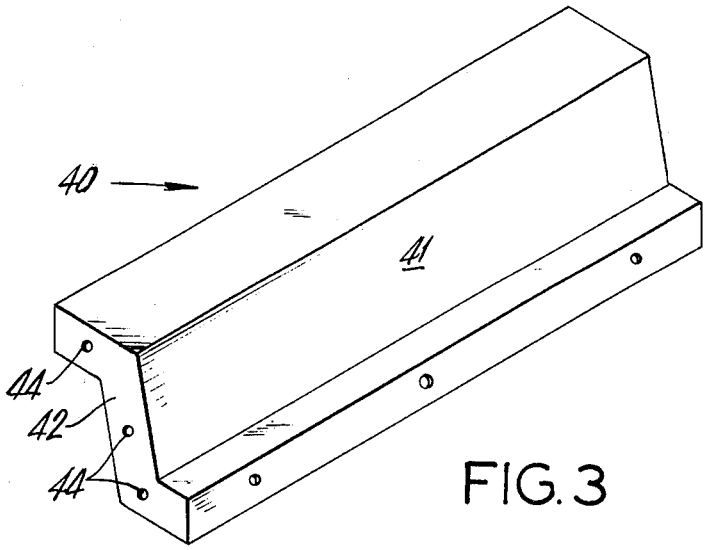
Figure 4:
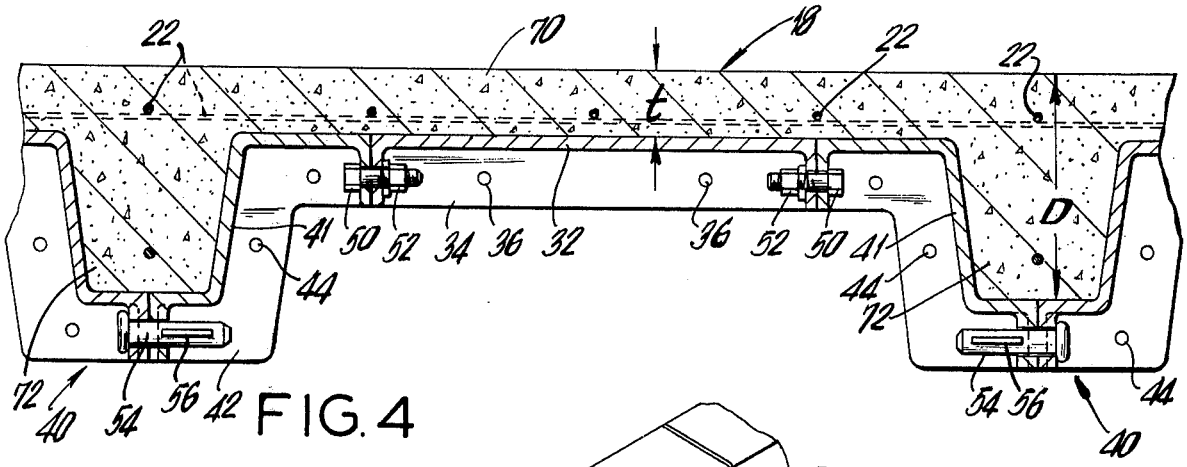
Figure 5:
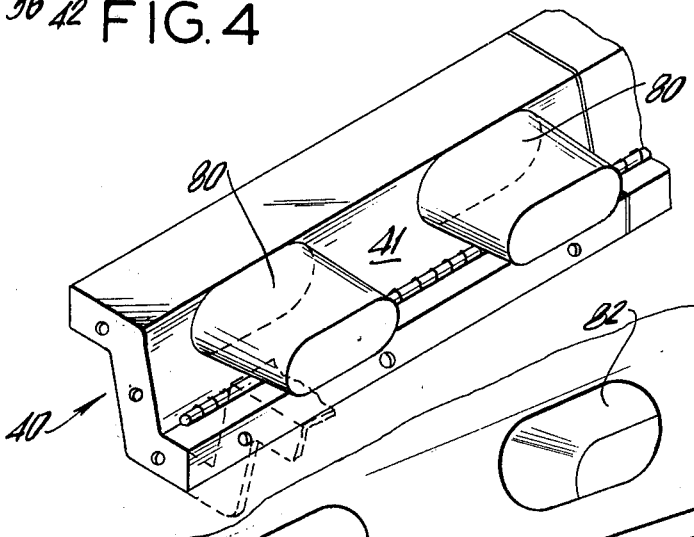
Figure 6:
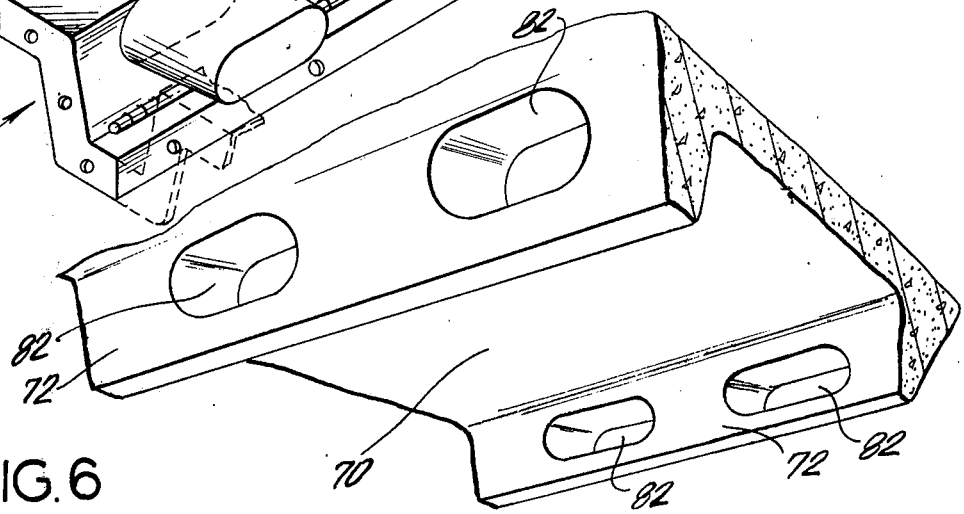
Figure 7:
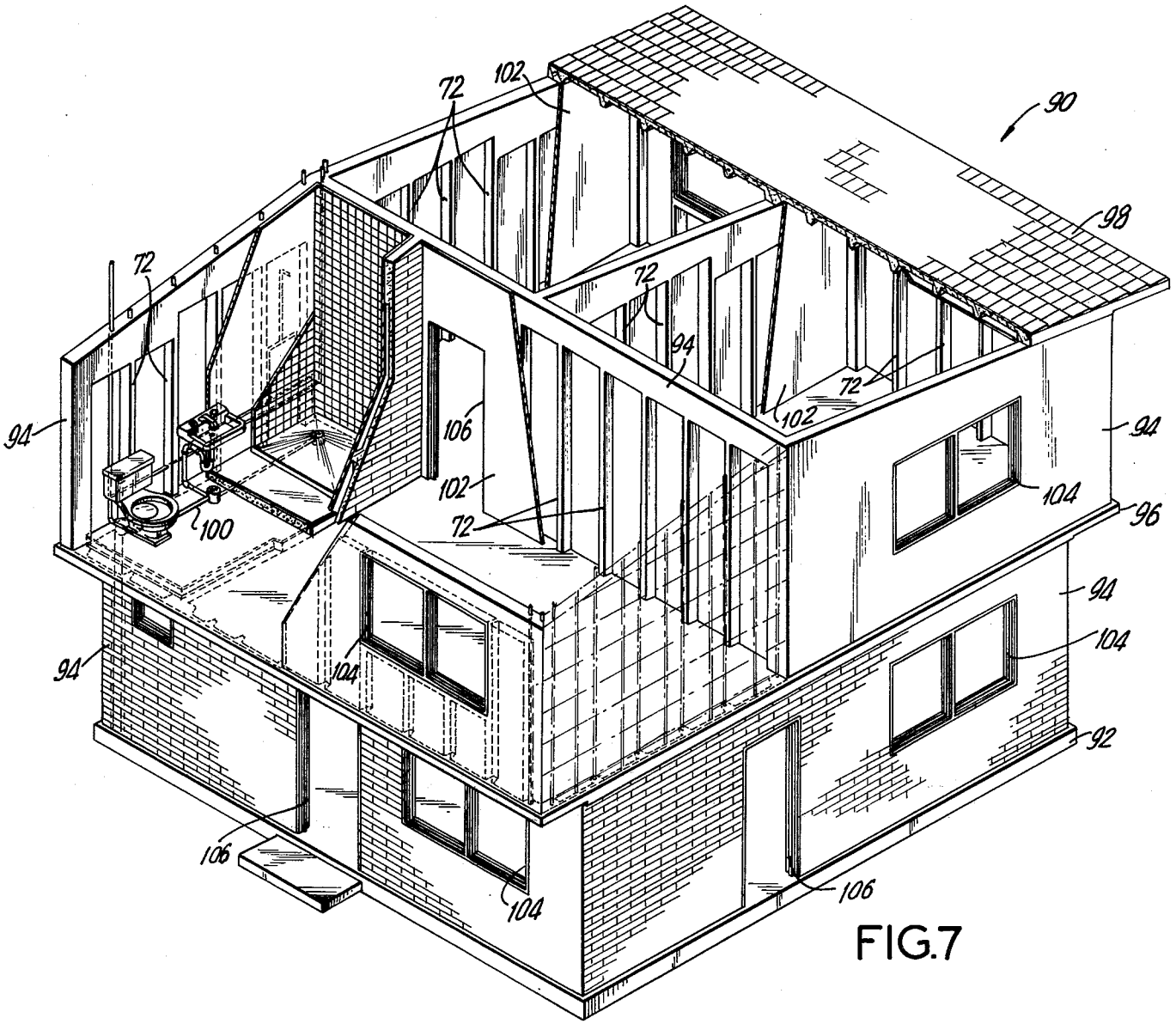
Figure 8A:
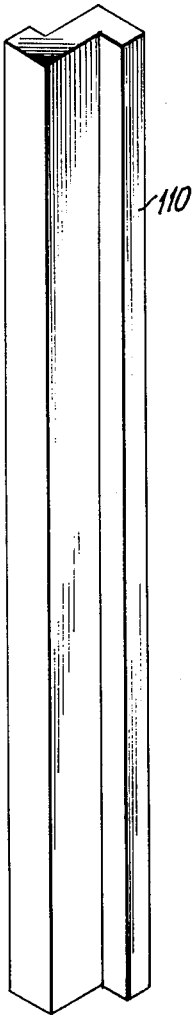
Figure 8B:
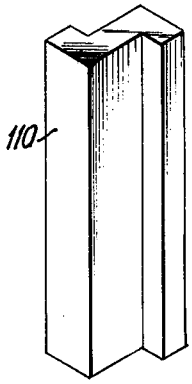
Figure 8C:
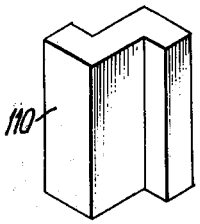
Figure 8D:
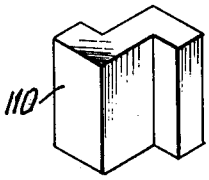
Figure 9:
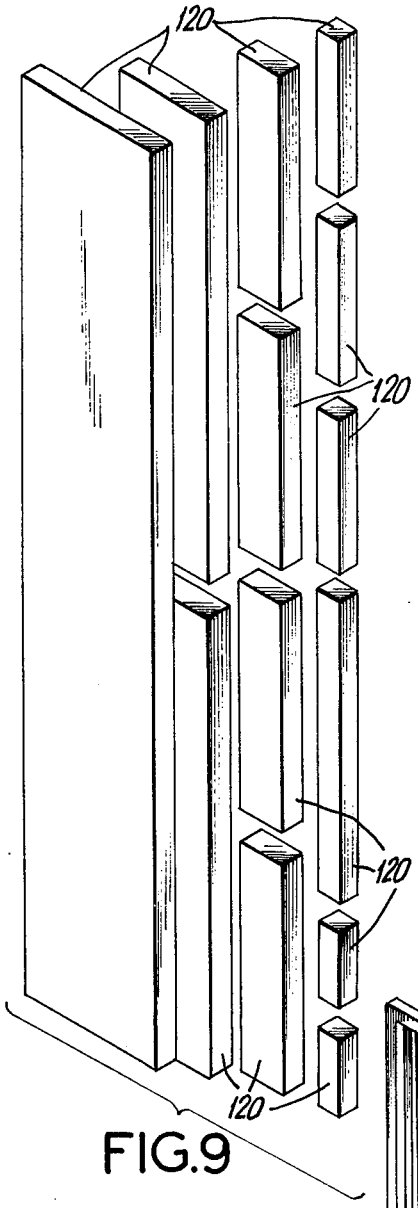
Figure 11:
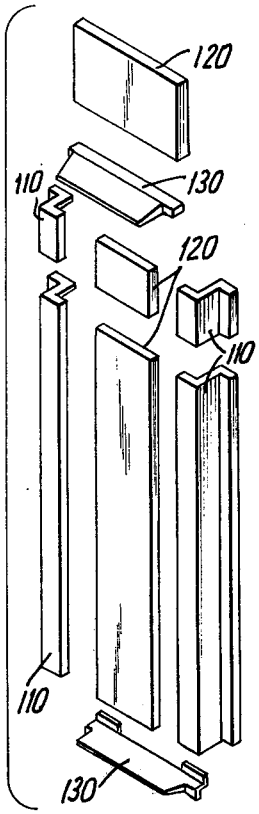
Figure 10:
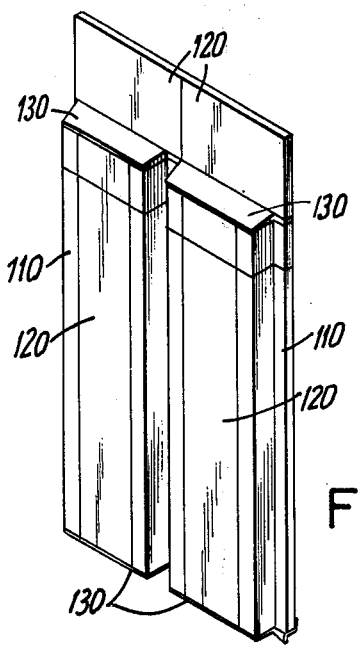
Figure 12:
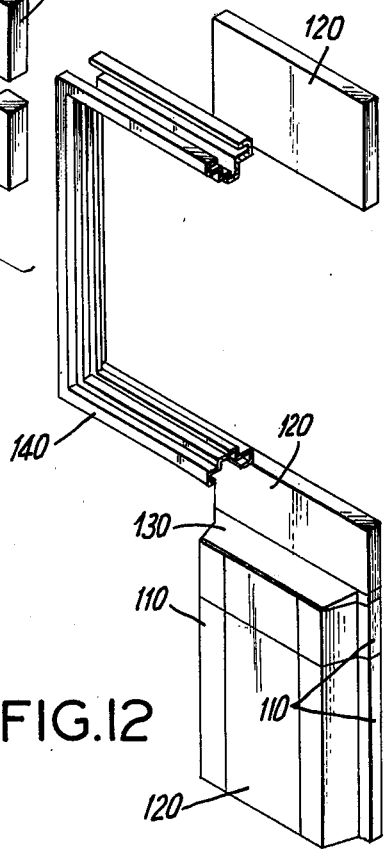
Figure 13:
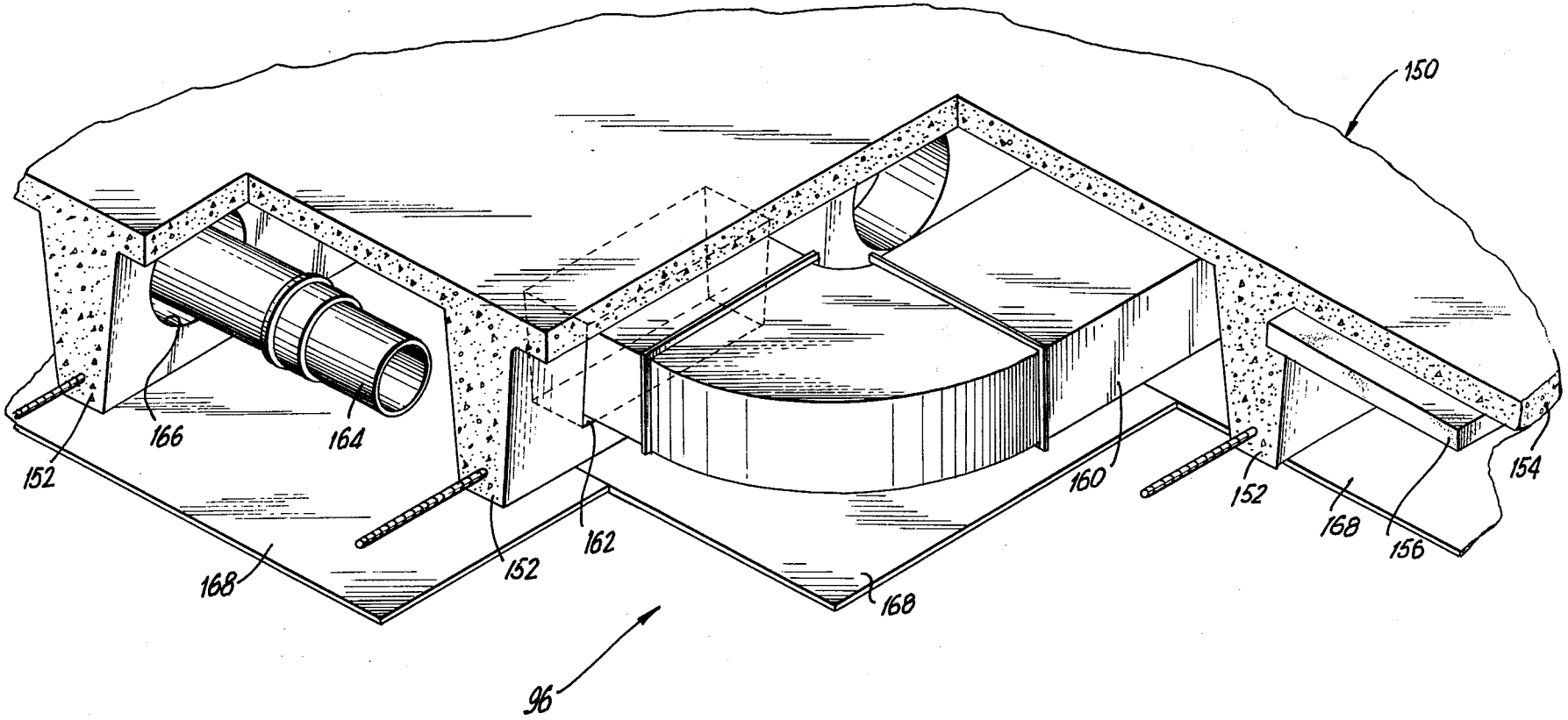

The subject invention consists in the construction, arrangements, and combination of the various parts of the subject concrete form, whereby the objects contemplated are attained as hereinafter more fully set forth and specifically pointed out in the claims, and illustrated in the accompanying drawings, in which:

FIG. 1 - is a perspective view of the use of the subject concrete form in the casting-in-place of a ceiling of a concrete structure;

FIG. 2 - is a perspective view, partly exploded, illustrating a concrete form of the subject invention;

FIG. 3 - is a perspective view of one of the metallic forms forming a portion of the concrete form of the subject invention;

FIG. 4 - is a sectional view taken along line 4-4 in FIG. 1;

FIG. 5 - is perspective view of the subject concrete form employing frangible mandrels;

FIG. 6 - is a perspective view of a resulting concrete structure which has been cast-in-place employing the modified concrete form as shown in FIG. 5;

FIG. 7 - is a perspective view of an entire house, partly in section, made according to the subject invention;

FIGS. 8A, 8B, 8C, 8D - are perspective views of the S-shaped forms of variable lengths of the subject invention;

FIG. 9 - illustrates various lengths of standard forms employed in the subject invention FIG. 10 - is a perspective view of a wall form made according to the subject invention;

FIG. 11 - is an exploded view of the wall form of FIG. 10;

FIG. 12 - illustrates the wall form of FIG. 10 employed in conjunction with a window opening, and FIG. 13 - is a partial sectional perspective view of a concrete floor made according to the subject invention and including duct work and other utilities extending therethrough.

Before describing the several embodiments of the subject invention it should be noted that although the detailed description refers to the building structure as a house, it is also contemplated that the subject invention may be employed for the construction of cast-in-place industrial buildings, warehouses, apartment houses, stores, and the like.

FIGS. 1 through 6 illustrate the use of the subject concrete form in connection with the casting-in-place of a concrete floor structure or a concrete ceiling structure, whereas FIGS. 7 through 13 illustrate other component forms which may be employed in the subject invention for the construction of a complete concrete building structure of a T-beam cavity construction, made according to the subject invention and employing the subject forms.

Turning now to FIGS. 1 through 7, FIG. 1 illustrates the use of the subject concrete form for casting-in-place the intermediate floor and ceiling of a multi-story building, or the roof of the building. The foundation 10 and upstanding walls 12 of the building are made according to well known techniques employing concrete forms 16, with the upstanding walls having reinforcing bars 14 embedded therein, made in accordance with the teaching of applicant's invention of U.S. Letter's Pat. No. 3,885,296, which issued on May 27, 1975 and is entitled "METHOD FOR MAKING CAST-IN-PLACE CONCRETE STRUCTURES."

After the upstanding walls have cured to a sufficient degree, the concrete forms 16 are removed, after which the subject concrete form, generally designated by numeral 20, is assembled, and supported by temporary shoring means (not shown) within the interior of the concrete structure preparatory to the pouring of the uncured concrete for forming the floor structure 18 (see FIG. 4). Prior to the pouring of the floor 18, the requisite number of reinforcing bars 22 are positioned within the concrete form 20.

The concrete form 20 of the subject invention is more particularly illustrated in FIGS. 2, 3, 4. As shown in FIG. 2, concrete form 20 basically comprises the interconnection of a plurality of individual concrete forms so as to define a planar form surface having a plurality of spaced, parallel elongated depressions. More particularly, concrete form 20 includes a plurality of generally planar forms 30 that are each preferably made of metallic material, such as light weight aluminum, and including a flat form surface 32 having a peripheral flange 34 including apertures 36 which are adapted to receive the fastening means for securing the forms together. The spaced parallel depressions are defined by generally U-shaped forms 40 they are likewise preferably made of a lightweight, yet strong, metallic material such as aluminum, and includes peripheral flanges 42 (see FIGS. 3 and 4) having apertures 44 therein for accepting releasable removable fastening means. As shown in FIG. 3, the U-shaped form 40 may be defined by two mirror imaged modified S-shaped forms, with the vertical portions 41 thereof being inclined so as to form a tapered depression, and resulting beam member, as more particularly illustrated in FIG. 4. The tapered configuration of the depression facilitates the removal of the form, following curing of the concrete. As also illustrated in FIG. 4, bolt 50 and nut 52 means may be provided for interconnecting the forms, or alternatively pin 54 and tapered wedge 56 means may be employed for releasably connecting the forms.

The concrete form 20 may also include end form 60 (see FIG. 2) which are adapted to be secured to the end flanges 34 and 42 of the planar forms 30 and U-shaped form 40 respectively, in order to prevent concrete from passing between the upstanding wall 12 and the concrete form 20. The end forms 60 include angled ends to conform to the tapered configuration of the U-shaped forms 40.

As illustrated in FIG. 4, the resulting concrete structure 18 includes a relatively thin planar slab portion 70 formed unitary with spaced, parallel strips or beams 72 of concrete. A typical application wherein the span of the concrete structure 18 is on the order of 14 feet, it has been found that sufficient structural rigidity is achieved by having the thickness *t* of the slab 18 on the order of one and 1/2 inches, whereas the depth D of the beam 72 may be on the order of 6 inches. In addition, the width of the planar form 32 may be on the order of 24 inches, whereby the beams 72 may be spaced on the order of approximately 30 inches. As is readily apparent, the resulting concrete structure 18 achieves the same or greater structural support, while employing preferably 50% of the concrete normally required for a conventional slab of uniform thickness of approximately 4 inches. It has also been found that only 50% of the reinforcing steel is required when employing the concrete form of the subject invention, as contrasted to a conventional floor slab of uniform thickness. Furthermore, because of the reduced amount of concrete required when employing the subject concrete form 20, less curing time of the concrete is required, yet the resulting concrete construction has greater load bearing capacity. Another advantage achieved employing the concrete form 20 of the subject invention is that because of the depth of the U-shaped concrete forms 40, the latter employ the I beam concept in inherently providing support for the forms and the uncured concrete, whereby the amount of temporary shoring required to support the concrete form 20 during the casting-in-place operation is greatly reduced.

After the concrete structure 18 has sufficiently cured, the concrete form 20 is removed, and because of the space below the slab 70 and intermediate beams 72, it is possible to duct service lines and utility lines in that space, and then provide a finishing surface to the lowest portion of the slab, such as by the use of plaster board, plywood, or the like secured to beams 72. To facilitate securing wall surfaces to the beam 72, furring strips may be placed within the U-shaped forms 40, prior to the pouring of the concrete therein, with the furring strips remaining embedded in the concrete for accepting nails, screws, and other fastening means.

As illustrated in the drawings the resulting concrete structure is of T-beam cavity construction which provides many of the advantages set forth above including reduced concrete, reduced labor requirements, greater strength-to-weight ratio, and the ability to duct service lines within the confines of the concrete structure.

FIG. 5 illustrates an alternate embodiment of the subject concrete form, in which mandrels 80 are positioned within the U-shaped form 40 and are made of frangible material, such as polystyrene. As illustrated in FIG. 5, the mandrels 80 extend perpendicular to the longitudinal axes of the U-shaped forms 40, and after the concrete structure 18 has been formed, such mandrels 80 may be readily removed, as shown in FIG. 6, thereby providing openings 82 in order to enable service lines, utility lines, and the like to be readily ducted therethrough in order to extend orthagonal to the longitudinal axes of the beams 72.

Referring to FIG. 7, a new and improved concrete structure made according to the subject invention, and constructed employing the concrete forms of the subject invention is designated by the numeral 90, and includes a foundation 92, upstanding exterior and interior walls 94 and intermediate floor 96, and a roof panel structure 98. As indicated in FIG. 7, all of the concrete panel structures forming the house 90 are of T-beam configuration so as to create cavities within said panels which function to reduce the volume of concrete required by the structure, as well as provide air space insulation in the upstanding walls and roof structure. As dictated by the structural requirements of the panels, the T-beam may be a variable depth. In addition, by the employment of the frangible mandrels, as illustrated in FIG. 5, it is possible to duct the plumbing 100 through the intermediate floor 96 and also through the upstanding walls 94. As indicated in FIG. 7, after the interior walls 94 have cured, the portion of the walls which expose the cavities intermediate the longitudinal beams 72 may be covered with a suitable facing member 102, such as plasterboard, plywood, etc. for aesthetic purposes, and also to hide insulation, service conduits, and the like which extend through the T-beam panels. As clearly shown in FIG. 7, because of the versatility of the subject invention, openings, such as windows 104, doorways 106 may be provided as as in conventional structures because of the versatility of the subject form system, as more fully described hereinafter. As noted in FIG. 7, the exterior of the cast-in-place concrete structure 90 about the periphery of the upstanding walls 94 may be of conventional planar design or conventional brick-pattern design as known in the art. Likewise, the roof configuration 98 may be of any conventional design.

FIGS. 8A, 8B, 8C and 8D illustrate one form of S-shaped form employed in the subject invention, said S-shaped forms being designated by the numeral 110 and being of variable length in order to enable the subject forming system to have maximum flexibility for constructing any complex building structure. The S-shaped forms 110 illustrated in FIGS. 8A through 8D are employed in conjunction with generally rectangular-shaped planar forms, similar to the forms 120 illustrated in FIGS. 1 and 2 and as more specifically illustrated in FIG. 9. Each of the forms 110 and 120 are provided with peripheral apertures to receive releasible fasteners for temporarily interconnecting the forms, as shown in FIG. 4.

For purposes of defining a portion of an upstanding wall beneath a window, such as window 104 in FIG. 7, a plurality of S-shaped forms 110 are employed in conjunction with rectangular forms 120 as illustrated in FIG. 9, and are releasably bolted together, as shown in FIG. 10. In addition to the S-shaped forms 110 and the planar forms 120, end forms 130 are employed, and FIG. 11 illustrates an exploded view of the composite of forms 110, 120 and 130 illustrated in FIG. 10. As shown in FIG. 12, the composite form illustrated in FIGS. 10 and 11 may be positioned below a conventional window frame 140 (see FIG. 12), with the upper portion of the window frame accepting a conventional planar form 120. As is readily apparent, because of the variable lengths and sizes of the S-shaped forms 110, as well as the planar forms 120, any complex configuration of the resulting form structure may be achieved for the construction of the building structure.

FIG. 13 illustrates a portion of an intermediate floor of a building structure wherein, by use of removable frangible mandrels employed during the formation of the floor 150 of T-beam construction, according to subject invention, it is possible to duct utility lines both longitudinally and transverse to the unitary beams 152 formed below planar slab 154. As shown, an air conditioning or heating duct 160 extends parallel to the beams 152, after which the duct extends transverse through an opening 162 in a beam, as does a plumbing pipe 164 extending through an opening 166 in an adjacent beam. As also illustrated in FIG. 13, secured to the beams 152 is a finished ceiling material, such as plasterboard or wall paneling designated by the numeral 168. Also, if desired, sheets of insulation 156 may be provided in the cavities between the beams of the T-shaped floor 150.

FIG. 13 illustrates the capability of the subject T-beam ceiling construction which enables the plumbing, duct work, and electrical wiring to be accommodated within the cavities intermediate the beams 152, thereby eliminating the necessity for a false ceiling, as required by the prior art systems wherein the ceiling is of uniform and constant depth.

Accordingly there has provided a new and improved T-beam cavity system, and a concrete form for making same. The subject invention, by virtue of the various sized elements, including the modified S-shaped forms, and the variable size planar forms provides a complete forming system which will enable floors, walls, roof, and an entire structure to be built of T-beam construction for creating a cavity between the beams. Due to this T-beam and cavity configuration, the volume of concrete required in this structure, as compared to conventional methods, is reduced up to 50% or more. The depth of the concrete beams may be varied to meet structural and span requirements, and if desired the exposed concrete beams may be covered with conventional wallboard members. In low cost housing, even without a covering, the subject invention provides a T-beam construction which is aesthetically pleasing, thereby further reducing the overall cost of construction. The cavity in the walls and roof created by the subject invention creates built-in dead air space which provides insulation at no extra cost, thereby reducing the cost of insulating the walls and roof. The cavity created by the form according to the subject invention reduces the dead weight of the entire structure and results in savings in multi-story buildings because each bearing wall can be of lighter section and foundations are greatly reduced in size, whereby less concrete and steel are required, thereby accomplishing substantial cost and material reductions. Concurrent with their savings are the savings achieved by the requirement of less labor in setting up the forms of the subject invention, and removing such forms after the concrete has been poured. As also indicated above, when the forms according to the subject invention are employed in connection with horizontal floor structures, the inherent strength of the S-shaped forms reduces the amount of temporary shoring required, thereby again resulting in a saving of labor costs.

In summary, the subject invention provides new and improved concrete forms for the construction of a new and improved concrete structure of T-beam configuration which achieves the following accomplishments: reduction in the amount of concrete required for the entire structure over conventional cast-in-place construction; substantial reduction in steel requirements in floors and other horizontal structures; substantial reduction in dead weight of the entire structure, thereby reducing structural requirements of all bearing walls and foundations; built-in insulation of the walls and roof due to the dead air space created by the T-beam system; reduction in labor costs by virtue of the reduced material concrete required; reduced steel; reduced temporary shoring required; built-in provisions for the placement of utility lines in the cavities created by the T-system, thereby eliminating in many cases the requirements for a false ceiling; a lightweight form system thereby eliminating the necessity for heavy equipment and thus reducing the amount of time required to set up and dismantle the forms; and a system which affords maximum versatility in order to enable the construction of extremely complex concrete structures. No other system has been concerned with the complete system of forms and accessories necessary to build a complete cast-in-place T-beam structure, that is, floor, walls, interior partitions and roof. The S-form of the subject invention in combination with the other necessary pieces of the equipment of the subject invention, for the first time, creates a complete T-beam cavity system, flexible enough in dimensional variability to adapt to the many and complex irregular dimensional requirements of floors, and created by irregular room sizes, closets, dimensions around openings, lengths and heights of the walls, etc. encountered in complex structures.

What is claimed is:

1. A concrete form for casting-in-place a concrete structure comprising a plurality of metallic form members interconnected so as to define a planar form surface having a plurality of spaced, parallel elongated depressions so as to form a planar concrete structure which is reinforced by spaced, unitary, parallel strips of concrete, said plurality of metallic form members including planar forms extending between said depressions, each said planar form comprising a flat metallic sheet having a peripheral reinforcing flange including apertures therein, and elongated U-shaped forms defining the depressions, each said U-shaped form comprising two mirrored sections, of generally S-shaped configuration, each S-shaped section being of unitary construction and including peripheral flanges having openings to accept means for removably securing the forms together.

2. A concrete form for casting-in-place a concrete structure as in claim 1 wherein said depressions are tapered such that said strips of concrete have their greatest thicknesses adjacent the planar concrete structure.

3. A concrete form for casting-in-place a concrete structure as in claim 1 wherein said form members are made of aluminum.

4. A concrete form for casting-in-place a concrete structure as in claim 1 wherein said form members are releasably interconnected by means of wedge and pin means.

5. A concrete form for casting-in-place a concrete structure as in claim 1 further including end forms which extend perpendicular to the plane of said planar forms, and extend between two opposed faces of said depressions and the intermediate planar form.

6. A concrete form for casting-in-place a concrete structure as in claim 1 further including removable frangible mandrels disposed in said depressions, and extending perpendicular to the length of said depressions so as to form removable portions of the resulting strips of concrete.

7. A concrete form for casting-in-place a concrete structure as in claim 6 wherein said removable frangible mandrels are made of polystyrene.

* * * * *